US007165582B2

(12) United States Patent
Till

(10) Patent No.: US 7,165,582 B2
(45) Date of Patent: Jan. 23, 2007

(54) BEVERAGE BOTTLING PLANT FOR FILLING BOTTLES WITH A LIQUID BEVERAGE FILLING MATERIAL, A BEVERAGE CONTAINER FILLING MACHINE, AND A BEVERAGE CONTAINER CLOSING MACHINE

(75) Inventor: Volker Till, Hofheim/Taunus (DE)

(73) Assignee: KHS Maschinen-und Anlagenbau AG, Dortmund (DE)

( * ) Notice: Subject to any disclaimer, the term of this patent is extended or adjusted under 35 U.S.C. 154(b) by 0 days.

(21) Appl. No.: 10/865,240

(22) Filed: Jun. 10, 2004

(65) Prior Publication Data

US 2005/0016624 A1 Jan. 27, 2005

(30) Foreign Application Priority Data

Jun. 13, 2003 (DE) ..... 103 26 618

(51) Int. Cl.
*B65B 3/04* (2006.01)

(52) U.S. Cl. ..... 141/89; 141/144

(58) Field of Classification Search ..... 141/5–7, 141/11, 51, 47–49, 63, 64, 85, 89, 91–93, 141/129, 144–152; 53/88, 89, 95–97, 403, 53/425, 426, 432, 510
See application file for complete search history.

(56) References Cited

U.S. PATENT DOCUMENTS 3,018,184 A * 1/1962 Martin ..... 426/399
3,356,510 A * 12/1967 Barnby ..... 426/399
4,014,158 A * 3/1977 Rausing ..... 53/167
4,999,978 A * 3/1991 Kohlbach et al. ..... 53/512
5,551,207 A * 9/1996 Beyer et al. ..... 53/127
6,082,418 A * 7/2000 Naecker et al. ..... 141/145
6,185,910 B1 2/2001 Achhammer
RE37,471 E * 12/2001 Jagger ..... 53/282
6,830,084 B1 * 12/2004 Friede ..... 141/144

FOREIGN PATENT DOCUMENTS

| | | |
|---|---|---|
| DE | 696569 | 8/1940 |
| DE | 29713155 U1 | 10/1998 |
| DE | 19835369 C1 | 10/1999 |
| DE | 19911517 A1 | 9/2000 |
| EP | 0120789 | 3/1984 |

* cited by examiner

*Primary Examiner*—Justine Yu
(74) *Attorney, Agent, or Firm*—Nils H. Ljungman & Associates

(57) ABSTRACT

There is now provided a beverage bottling plant for filling bottles with a liquid beverage filling material, a beverage container filling machine, and a beverage container closing machine, wherein only the top portions of containers being processed are disposed in a chamber having rotatable walls and stationary walls. The abstract of the disclosure is submitted herewith as required by 37 C.F.R. §1.72(b). As stated in 37 C.F.R. §1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

16 Claims, 11 Drawing Sheets

SECTION A-A
IN FIG. 4A

SECTION B-B
IN FIG. 4A

SECTION A-A
IN FIG. 6A

FIG. 5
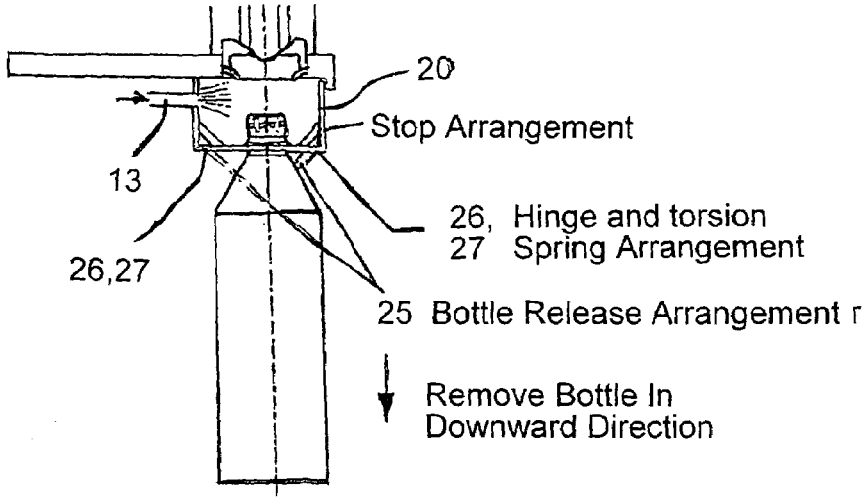
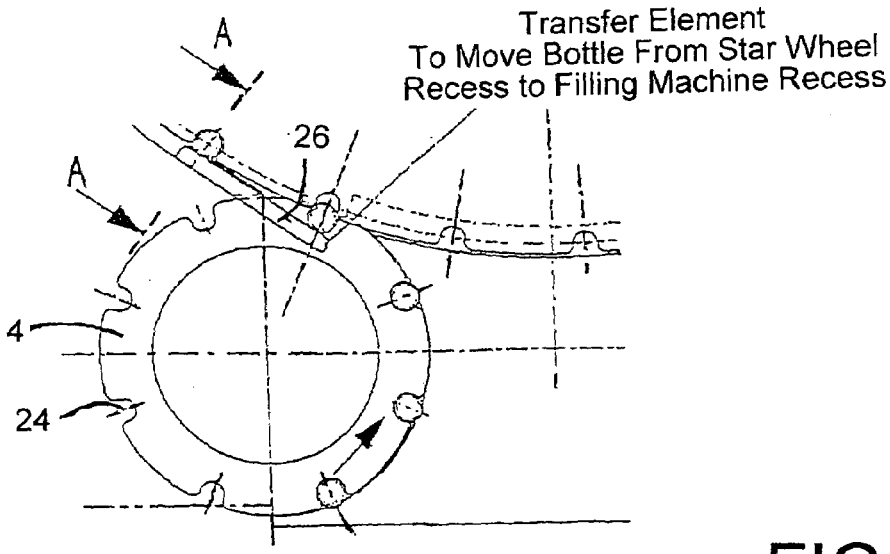
FIG. 6

BEVERAGE BOTTLING PLANT FOR FILLING BOTTLES WITH A LIQUID BEVERAGE FILLING MATERIAL, A BEVERAGE CONTAINER FILLING MACHINE, AND A BEVERAGE CONTAINER CLOSING MACHINE

BACKGROUND

1. Technical Field

This application relates to a beverage bottling plant for filling bottles with a liquid beverage filling material, a beverage container filling machine, and a beverage container closing machine.

2. Background Information

A beverage bottling plant for filling bottles with a liquid beverage filling material can possibly comprise a beverage filling machine with a plurality of beverage filling positions, each beverage filling position having a beverage filling device for filling bottles with liquid beverage filling material. The filling devices may have an apparatus being configured to introduce a predetermined volume of liquid beverage filling material into the interior of bottles to a substantially predetermined level of liquid beverage filling material, and the apparatus configured to introduce a predetermined flow of liquid beverage filling material comprising apparatus being configured to terminate the filling of beverage bottles upon liquid beverage filling material reaching said substantially predetermined level in bottles. There may also be provided a conveyer arrangement being configured and disposed to move bottles, for example, from an inspecting machine to the filling machine. Upon filling, a closing station closes filled bottles. There may further be provided a conveyer arrangement configured to transfer filled bottles from the filling machine to the closing station. Bottles may be labeled in a labeling station, the labeling station having a conveyer arrangement to receive bottles and to output bottles. The closing station and the labeling station being connected by a corresponding conveyer arrangement.

Thus, in one aspect, container handling machines comprise, for example, filling machines, closing machines, rinsers, and the like. In the case of increased production ratings, they are configured as rotatable arrangements and the handling positions that hold the containers are disposed at the circumference of the carousel and the positions move the containers during handling.

With an increased demand for quality of the beverage to be filled into containers and its stability of durability, there is at hand a type of arrangement in which the handling positions are disposed in a closed space that is supplied with a special atmosphere. Such a space can be supplied with an inert atmosphere, for example, carbon dioxide, with a sterilizing atmosphere, or with hydrogen peroxide and thus can ensure a treatment of the beverage that is low in oxygen and low in germs, this being of paramount importance for the filling quality of the beverage. Such handling machines are known in many varieties in the beverage industry.

German Patent No. DE-PS 696,569 shows an arrangement in which a filling machine is disposed in a closed housing. The space that is provided in this manner is determined by the full size of the machine and has a substantial volume. German Patent Publication No. DE-OS 199 11 517 A1 shows a rotating filling machine that is fully disposed in a tightly surrounding housing that has a size that is determined by the size of the machine and, accordingly, the housing is also of substantial volume. German Patent No. DE-PS 198 35 369 C1 shows an embodiment in which the lower handling positions of container handling machines extend in sealed manner from above into a space that is supplied with a special atmosphere. This space is equipped so as to be accessed from below.

A further solution is disclosed in German Patent Publication No. DE-OS 197 31 796. The technical embodiment of this reference comprises a filling machine and a closing machine that are both disposed in a clean space or room that has a volume that is dimensioned so as to be so tight such that there is only space for maintenance at the filling machine and at the closing machine. By way of the reduction of the volume of the clean space, a lowering of the operating expense of the arrangement is to be attained. In addition, an immersion bath sterilizer is directly disposed at the clean space. This measure is to achieve, in contrast with European Patent No. EP 0120 789, to make the second rinser superfluous and to obviate associated operating and capital expenditures. This solution comprises overall the drawback that also in this embodiment there is suggested a clean space that fully envelops the filling machine, as well as the closing machine, and this arrangement requires a large amount of space and high construction and operating expenses. The desired extensive reduction in size of the constructive volume of the clean space that is sought in this teaching entails marked disadvantages, due to the diminished accessibility when maintenance is to be carried out.

The substantial volume of the space that is supplied with a special atmosphere is, accordingly, of disadvantage in the designs of the prior art. In the event of disruptions of operations, the space needs to be opened. It is then filled with normal ambient air and is correspondingly accessible to germs. The subsequent cleaning of the space prior to resumption of operations is largely determined by the surfaces and the overall volume of the space. In the case of the known large clean rooms, accordingly, the interruptions of operations, that are necessary due to disruptions of operations, or required relocation of machines, as well as the unavoidable cleaning of machines, last for hours.

From German Patent Publication No. DE-OS 101 45 803 A1 (corresponding to International Patent Publication No. WO 03/024860 A1, published on Mar. 27, 2003) and German Petty Patent No. DE-GM 297 13 155 U1, (corresponding to U.S. Pat. No. 6,026,867 issued to Karl on Feb. 22, 2000), it is finally known that the closed space is configured as an annular tunnel structure that moves about/or surrounds the carousel of the filling machine and the annular boiler, on the one hand, and by the stationary surfaces, on the other hand, whereby the carousel surfaces and the stationary surfaces are disposed in sealing manner atop one another or, respectively, with respect to one another by way of concentric seal elements. These known configurations already substantially reduce the required clean space.

OBJECT

It is an object to minimize the volume of a chamber configured to disinfect containers, such as, bottles, in a container filling plant, by solely enclosing the top portions of the containers.

SUMMARY

The application teaches that this object can be accomplished by an embodiment that is believed at the time of the filing of this patent application to possibly reside broadly in a container handling machine for handling beverage containers, such as, bottles and the like, the machine comprising a carousel that rotates about a vertical axis, the carousel comprising handling positions that are disposed at a distance from one another and that are configured to hold the beverage containers, whereby the handling positions are disposed in a substantially closed space that is supplied with a special atmosphere, the space comprising rotatable components and components that are fixed relative thereto, characterized in that this space 15 embraces only a portion of the beverage containers 16 at least the mouth portions 17 of the beverage containers.

Another feature or aspect of an embodiment is believed at the time of the filing of this patent application to possibly reside broadly in a container handling machine characterized in that at least a portion of the container 16 that is disposed away from the mouth portion and/or the centering device thereof is disposed to remain outside of the clean space 15.

Yet another feature or aspect of an embodiment is believed at the time of the filing of this patent application to possibly reside broadly in a container handling machine characterized in that at least one wall that defines the clean space 15 and that moves with the rotatable carousel comprises the holder, and/or the support, and the centering device 24 for the mouth portion 17 of the beverage containers 16, and/or supports such components.

Accordingly, in one aspect, the handling machine comprises a clean room, or a clean space, or a clean chamber that comprises a rotatable component and a component that is fixed relative thereto, i.e., a stationary component, and the chamber only embracing the mouth portions of the beverage containers.

In this, a delimiting wall of the clean chamber, which wall rotates with the rotating carousel, comprises the holders, and/or the supports, and the centering arrangements for the mouth portions, or the components thereof, such as, neck rings, and the like, of the beverage containers. The holders, supports, and centering arrangements or centering devices are suitably disposed in the lower delimiting wall of the clean chamber which wall is rotated.

With the present embodiments of the application the clean chamber capacity is reduced to a very low volume which ensures a very economic filling of respective beverages.

Further features of the application are contained in dependent claims.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The embodiments of the application are explained in greater detail below with reference to the accompanying drawings.

FIG. 5 illustrates a bottle unload arrangement for special cases that are caused by disruptions, along line A—A in FIG. 6;

FIG. 6 illustrates a transfer arrangement for transferring bottles from the input star conveyer to the filling machine.

DESCRIPTION OF EMBODIMENTS

Figure 1:
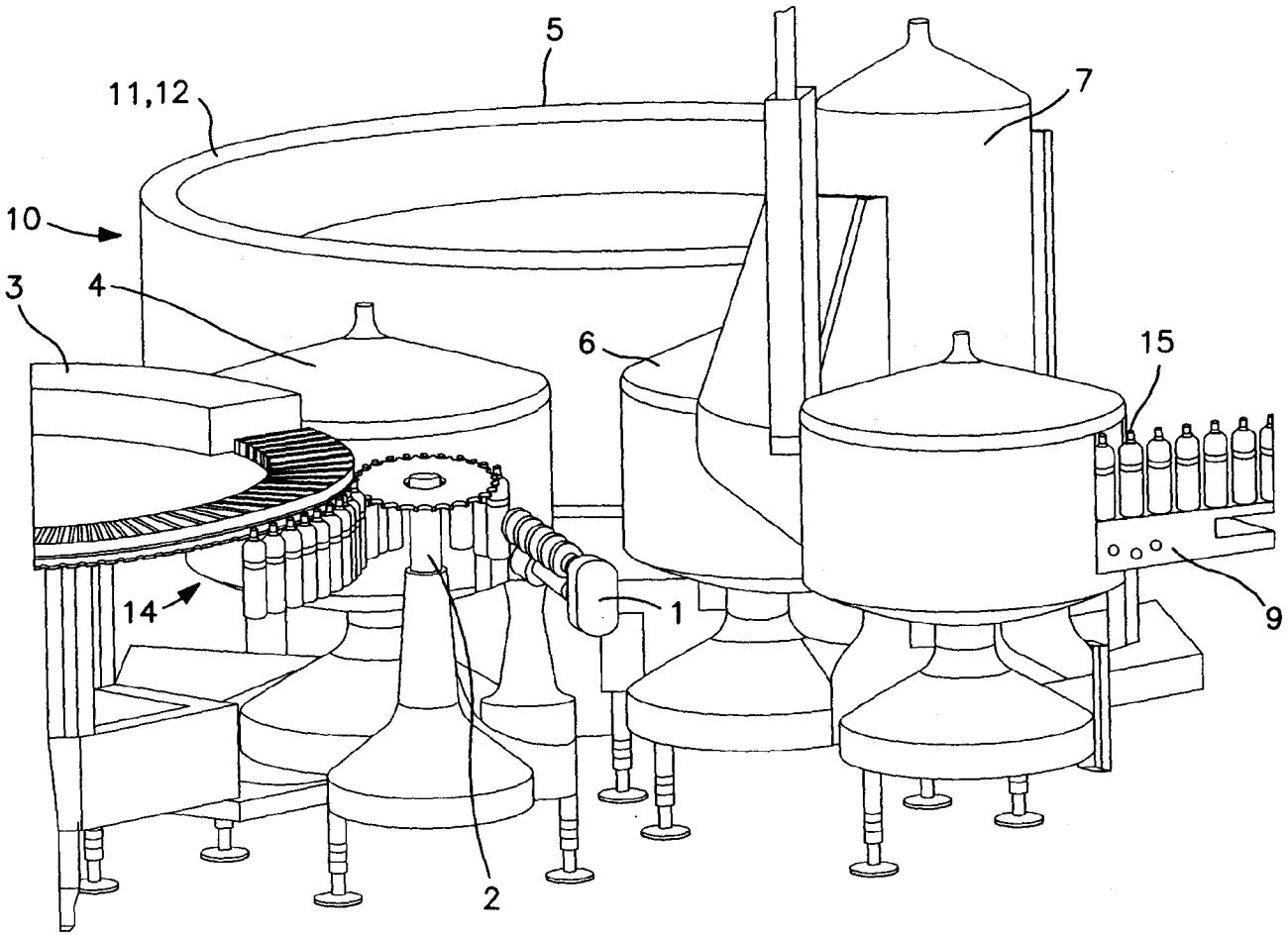
FIG. 1 PRIOR ART
FIG. 1 is a perspective illustration of a state of the art machine arrangement for rinsing, filling, and closing of containers with a rotating annular chamber, partly shown as an exploded view.
Figure 1A:
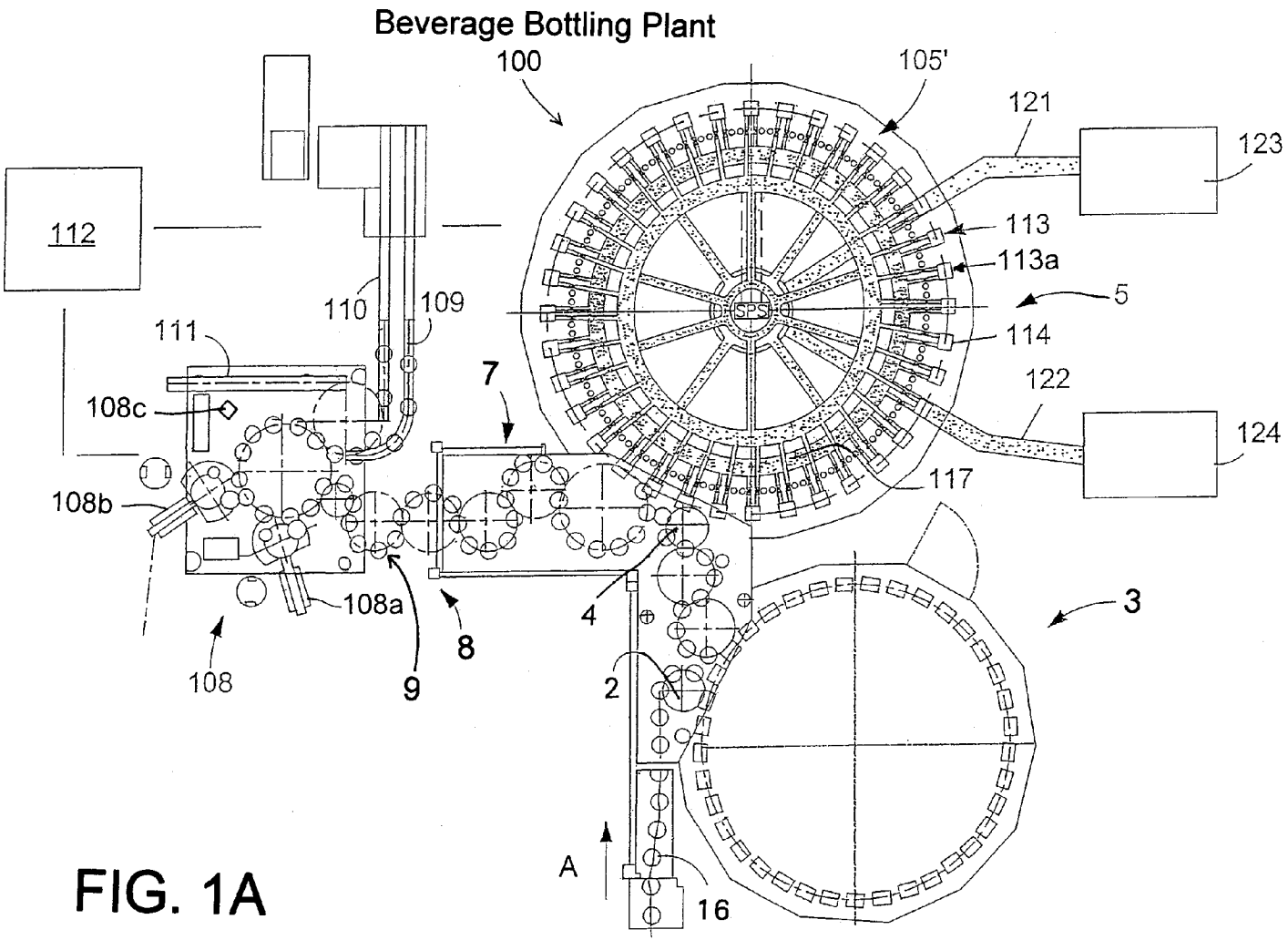
FIG. 1A is a top plan view illustrating schematically a beverage bottling plant in accordance with one embodiment of the application.

FIG. 1A shows schematically the main components of one embodiment example of a system for filling containers, specifically, an embodiment of a beverage bottling plant 100 for filling bottles 16 with liquid beverage filling material, in accordance with one embodiment, or in which system or plant could possibly be utilized at least one aspect, or several aspects, of the embodiments disclosed herein.

FIG. 1A shows a rinser or rinser station 3, to which the containers, namely bottles 16, are fed in the direction of travel as is indicated by the arrow A, by means of a conveyer line or conveyer arrangement 2, and downstream of rinser station 3, in the direction of travel as is indicated by the arrow A, the rinsed bottles 16 are transported to a beverage filling machine 5 by means of a conveyer line or conveyer arrangement 4 that is formed, for example, by a star wheel conveyer or a plurality of star wheels of a conveyer arrangement as is known in the art. The conveyer arrangement 4 may possibly have a star wheel that introduces bottles 16 to the filling machine 5.

Downstream of the filling machine 5, in the direction of travel of the bottles 16, there may possibly be a closer or closer station 7 which closes the bottles 16.

The closer or closer station 7 can, for example, be connected directly to a labeling device or labeling station 108, such as, for example, by means of a conveyer line or conveyer arrangement 9 that may be formed, for example, by a plurality of star wheels of a conveyer arrangement.

In the illustrated embodiment, the labeling device or labeling machine or labeling station 108 has, for example, three outputs, namely one output formed by a conveyer or conveyer arrangement 109 for bottles 16 that are filled with a first product. The first product may possibly be provided by a product mixer 123 that is connected to the filling machine 5, for example, through a conduit arrangement 121, and bottles 16 that are filled with a predetermined volume of liquid beverage filling material, that is, the first product, are then labeled by a labeling module 108*a* in the labeling stations 108 corresponding to this first product delivered from product mixer 123 to the beverage filling machine 5 and thence to the corresponding bottles 16.

A second output that is formed by a conveyer or conveyer arrangement 110 is provided for those bottles 16 that are filled with a second product. The second product may emanate from a second product mixer 124 that is connected, for example, through a conduit arrangement 122 to the filling machine 5, and these bottles 16 filled with a predetermined volume of liquid beverage filling material comprising the second product are then correspondingly labeled by a labeling module 108*b* in the labeling station 108 corresponding to this second product.

A third output, for example, formed by a conveyer or conveyer arrangement 111, removes any bottles 16 which have been incorrectly labeled as may have been determined by an inspecting device or an inspecting station, or an inspecting module 108*c* that may possibly form a part of the labeling station 108.

In FIG. 1A item 112 is a central control unit or, expressed differently, a controller or a system which includes a process controller that, among other things, controls the operation of the above-referenced system or plant.

The beverage filling machine 5 may possibly be of the revolving design, with a rotor 105', which revolves around a vertical machine axis. On the periphery of the rotor 105' there are a number of filling positions 113, each of which comprises bottle carriers or container carriers, such as generally identified by reference numeral 113*a* that are configured and disposed to present bottles 16 for filling, as well as a filling device or element or apparatus 114 located or configured to be located above the corresponding container carrier 113*a* and the corresponding bottle 16 presented by the carrier 113*a*. The filling device or apparatus 114 comprises an apparatus configured to introduce a predetermined volume of liquid beverage filling material into the interior of bottles 16 to a predetermined level of liquid beverage filling material. Furthermore, the filling device or apparatus 114 comprises an apparatus configured to terminate the filling of bottles upon liquid beverage filling material reaching the predetermined level in bottles 16. In other words, the filling elements 114 are configured and disposed to provide a predetermined flow of liquid beverage filling material from the source thereof, such as, product mixers 123 and 124, into the bottles 16.

A toroidal vessel 117 is a component, for example, of the revolving rotor 105'. The toroidal vessel 117 can be connected by means of a rotary coupling or a coupling that permits rotation, and by means of conduit arrangement or connecting line 121 to the external reservoir or product mixer 123 to supply the product, that is, product mix one, for example.

As well as the more typical filling machines having one toroidal vessel, it is possible that in at least one possible embodiment a filling machine could possibly be utilized wherein each filling device 114 is possibly connected by means of two connections to a toroidal vessel 117 which contains a first product, say by means of a first connection, for example, conduit arrangement 121, and to a second toroidal vessel which contains a second product, say by means of the second connection, for example, conduit arrangement 122. In this case, each filling device 114 can also possibly have, at the connections, two individually-controllable fluid or control valves, so that in each bottle 16 which is delivered at the inlet of the filling machine 5 to a filling position 113, the first product or the second product can be filled by means of an appropriate control of the filling product or fluid valves.

It will be understood that while a two-product assembly or system of a bottling plant is illustrated in FIG. 1A, the disclosure is equally applicable to single-product installations, or other commensurate embodiments.

FIG. 1 is a perspective illustration of a state of the art machine arrangement for rinsing, filling and closing of containers, for example, PET bottles (polyethylene terephthalate bottles).

The containers 16 are passed to the machine arrangement by way of known conveyers, that are not shown in greater detail but briefly described above with reference to FIG. 1A, and a dividing screw 1 serves to arrange the containers so as to be divided and spaced from one another. Transport star 2 passes the containers initially to rinser 3. The PET bottles that are illustrated in this described embodiment are interiorly and exteriorly rinsed with a suitable treatment liquid, for example, sterile water, or a disinfecting liquid. In another suitable configuration of an equipment installation, in place of a rinser, other cleaning and disinfecting equipment, such as, immersion bath sterilizers, and/or plasma disinfecting equipment, may be disposed ahead of the filling machine 5. Upon the PET bottles having been conveyed through the rinser 3, they are passed by way of further transport star 4 to the actual filling machine 5. Next in line of the filling process, the PET bottles are removed by further transport star 6 from the filler 5 and are passed to the closer 7. Subsequently, further transport star 8 removes the PET bottles from the closer 7 and transfers the bottles to conveyer 9 that passes the PET bottles to the next processing step, for example, a labeling station, say labeling station 108 in FIG. 1A. The components hitherto used in a container handling installation, such as, rinser 3, filler 5, closer 7, and transport stars 2, 4, and 6 are of known design and can have various configurations.

In the illustrated embodiment, the filling machine 5 is of a rotating design. The rotating part of the filling machine, in one embodiment the so-called carousel, is surrounded by an enclosure 10 that does not rotate, that is, the enclosure is stationary. The upper portion of the enclosure 10 configures an annular channel 11 that fully surrounds the carousel and that is separated from the carousel by a narrow annular gap 12.

The enclosure 10, furthermore, configures, in conjunction with the geometric design of the rotating carousel of the filling machine 5 a treatment chamber whereby the enclosure 10 is configured in such a way that there remains a narrow gap 14 at the lower end of the enclosure between the enclosure 10 and the rotating carousel of the filling machine, with this gap fully extending about the circumference of the carousel.

The annular channel 11 is supplied with a processing gas that is under an over-pressure by means of at least one input conduit 13, with the processing gas comprising, for example, sterile air, carbon dioxide, hydrogen peroxide, or another suitable gas or gas mixture. By way of openings that are not shown in greater detail in the annular channel 11, the processing gas initially flows into the above described treatment chamber and subsequently flows in a widened stream in the direction of the openings that are present, that is, the annular gaps 12 and 14. Since the processing gas is continuously exiting at these openings, any ingress of germs and/or other dirt particles is securely avoided.

Figure 2A:
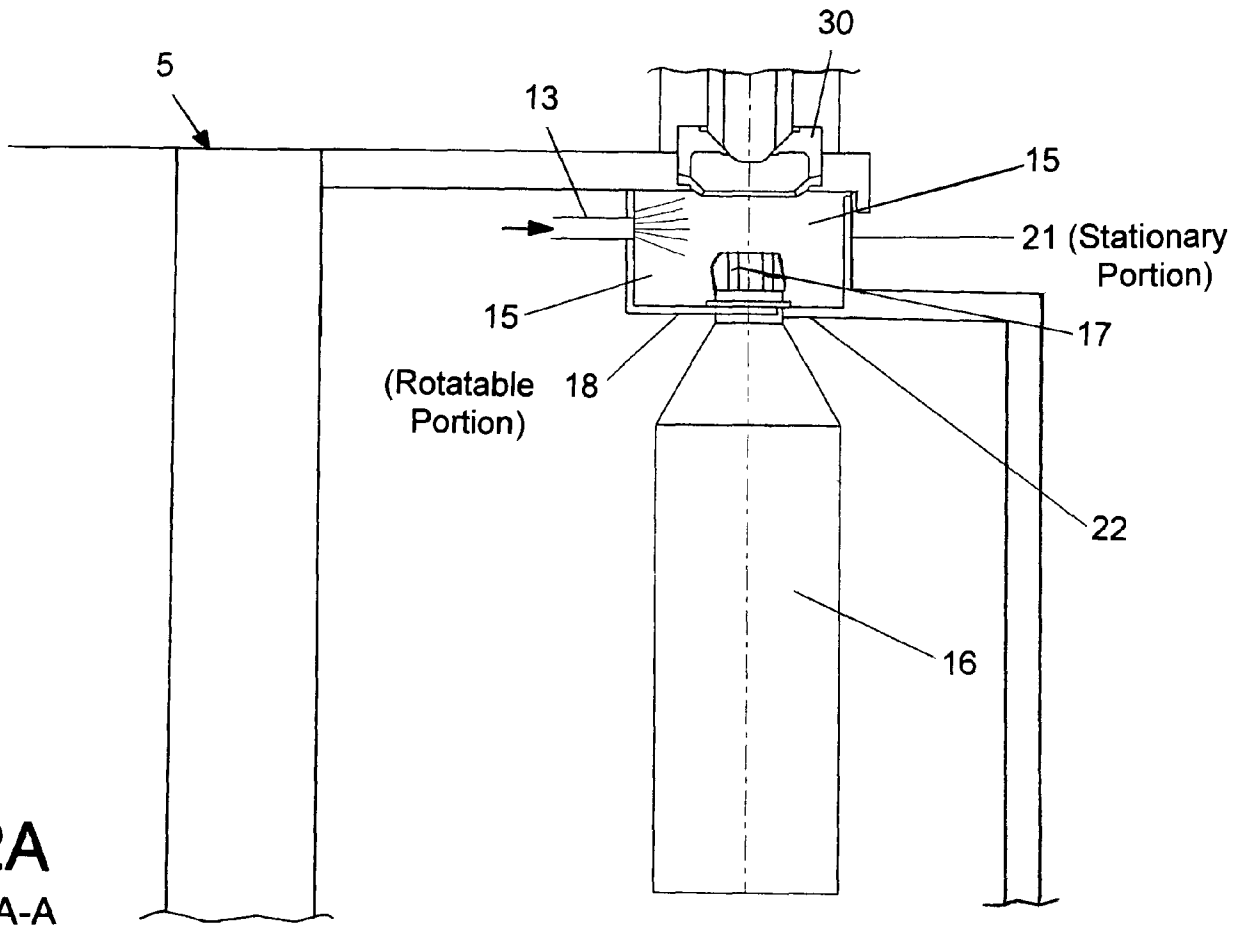
FIG. 2A is a view similar to FIG. 2 drawn to a larger scale and including identification of further detail.
Figure 2B:
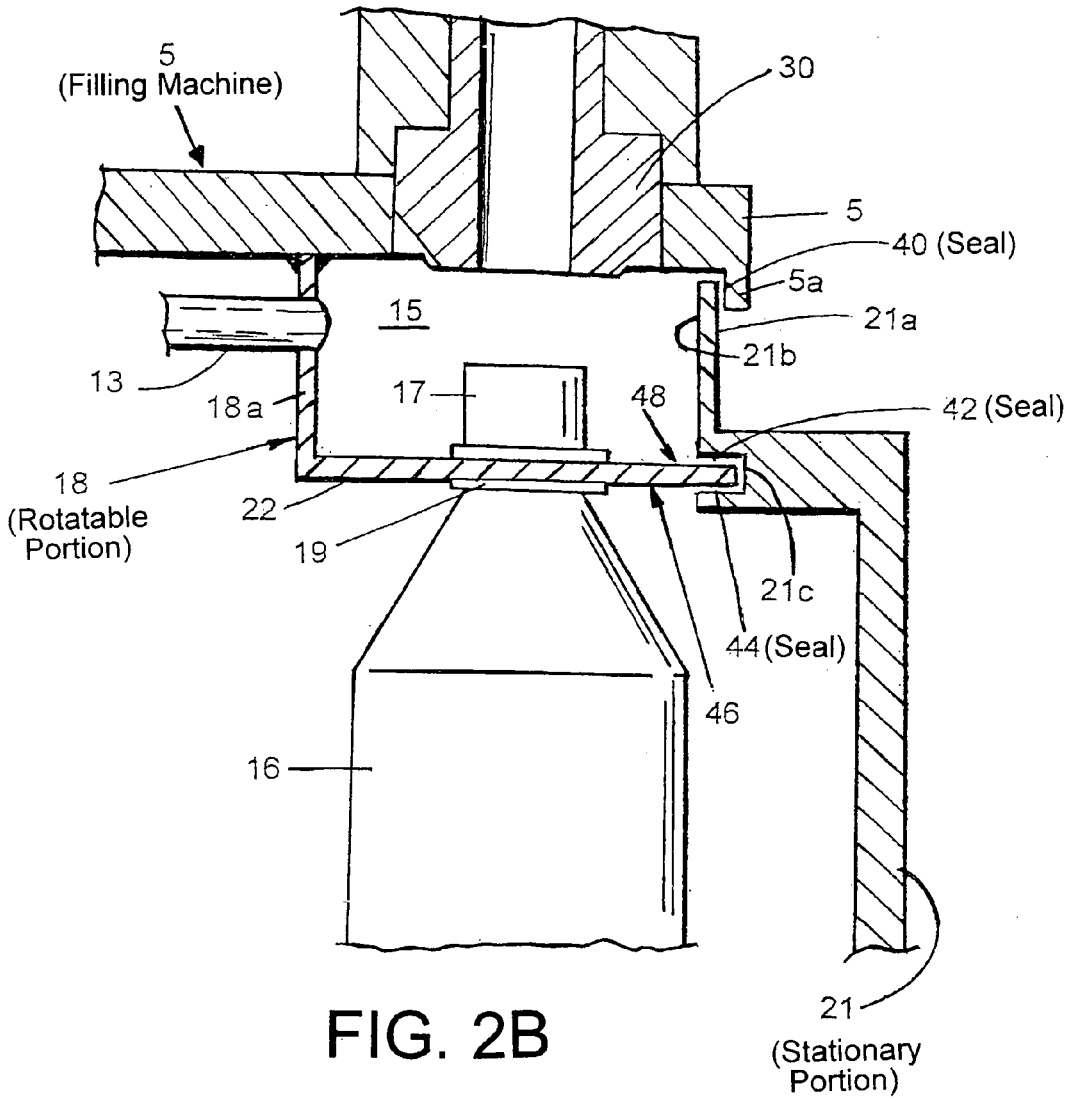
FIG. 2B is a view similar to FIG. 2 drawn to a larger scale and including identification of further detail.
Figure 2:
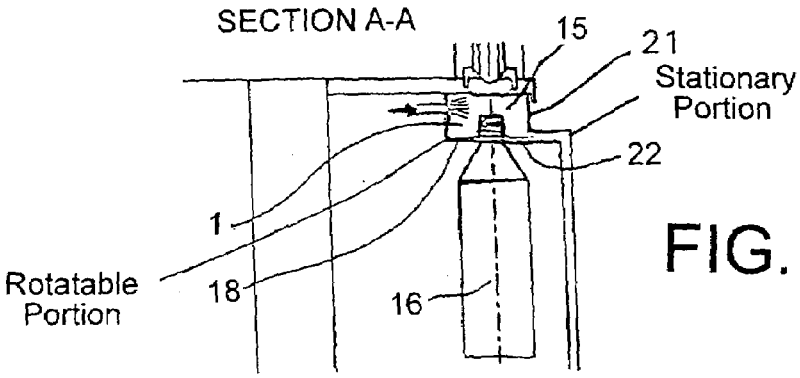
FIG. 2 is a detail illustration of the embodiment in accordance with the application of the housing in the region of the filling machine, along line A—A in FIG. 4.

In accordance with the embodiment that is illustrated in FIG. 2, and in contrast with the known annular chamber that is identified by reference numeral 11 in FIG. 1, the clean chamber in accordance with the application comprises a chamber, or a space, or a room 15 that surrounds only a portion of the beverage containers 16, namely, at least the mouth portions 17 thereof. In other words, chamber 15 is generally configured by rotatable portions or components 18 and by stationary portions or components 21. In this, the holders, supports and centering arrangements or centering devices 19 for the bottle mouths 17 are possibly directly disposed at the lower horizontal wall surface 18 that is rotating with the machine carousel. Such elements 19, accordingly, can comprise simple semicircular openings. On the other hand, other embodiments can be provided for the respective purpose. Thus, it is within the scope of the application that at the rotating wall of the chamber there are provided specially configured support fingers, or clamping fingers, and the like that can be accessed in the input regions and in the output regions for holding and for transferring. The outwardly directed centering of the circulating containers, or, respectively, the mouth portions thereof, is assuredly provided by a stationary chamber portion 20. This chamber portion 20 is practically configured rectangularly and it possibly forms a vertically projecting outer wall 21 and the inwardly directed centering wall 22 that can also be provided with a seal for sealing the annular gap. For enhancing cleaning, the centering wall 22 can also be disposed somewhat slopingly. The input region and the output region of such a filling machine 5 are possibly formed by rotating stars 4 and 8.

FIG. 2A is a view similar to FIG. 2, but drawn to a larger scale and additionally showing a filling valve 30.

FIG. 2B illustrates in particular detail a seal arrangement 40 between surface 5*a* of a portion of filling machine 5 and surface 21*a* of stationary wall portion 21*b*. There may be provided similar seal arrangements 42 and 44 between the projecting portion of centering wall 22 and the groove 21*c* of the stationary wall 21. The centering wall 22 may comprise a slot, or slots, or similar openings 46 that may be covered by a cover, or covers, 48. Such covers 48 may possibly be actuated by cam arrangements configured and disposed to move the covers 48 to cover and uncover the slots or openings 46. Seals may be superfluous in at least one embodiment in which the disinfecting medium is introduced into chamber 15 with sufficient pressure to prevent ingress of microorganisms.

The conduit 13 is introduced, in one embodiment, through a vertical wall 18*a* that is part of the filling machine 5.

Figure 3A:
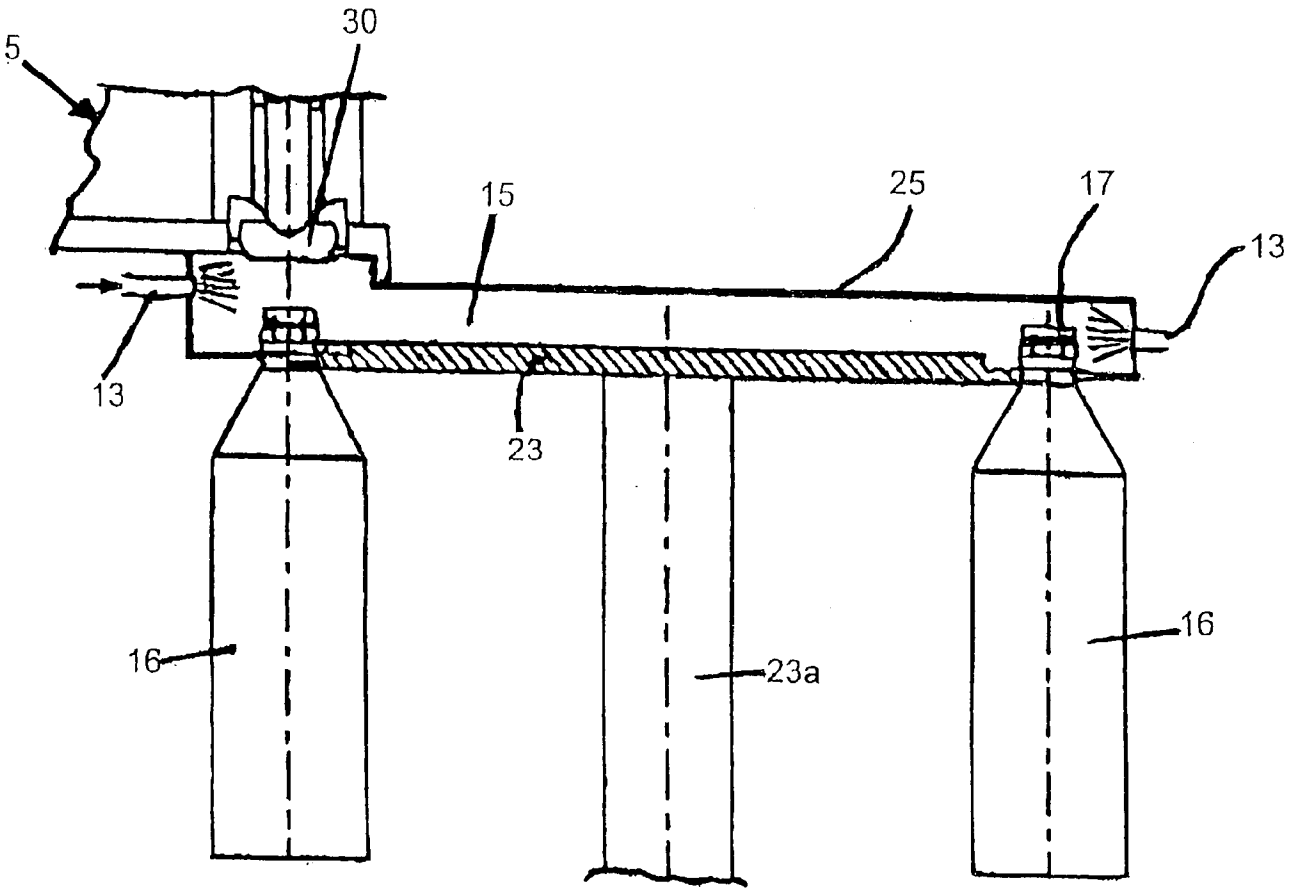
FIG. 3A is a view similar to FIG. 3 drawn to a larger scale and including identification of further detail.

In FIG. 3A, the flat disc 23 is shown to be rotatably disposed by mens of a shaft 23*a*. FIG. 3A also indicates a filling valve 30, as is known in the art.

Figure 4A:
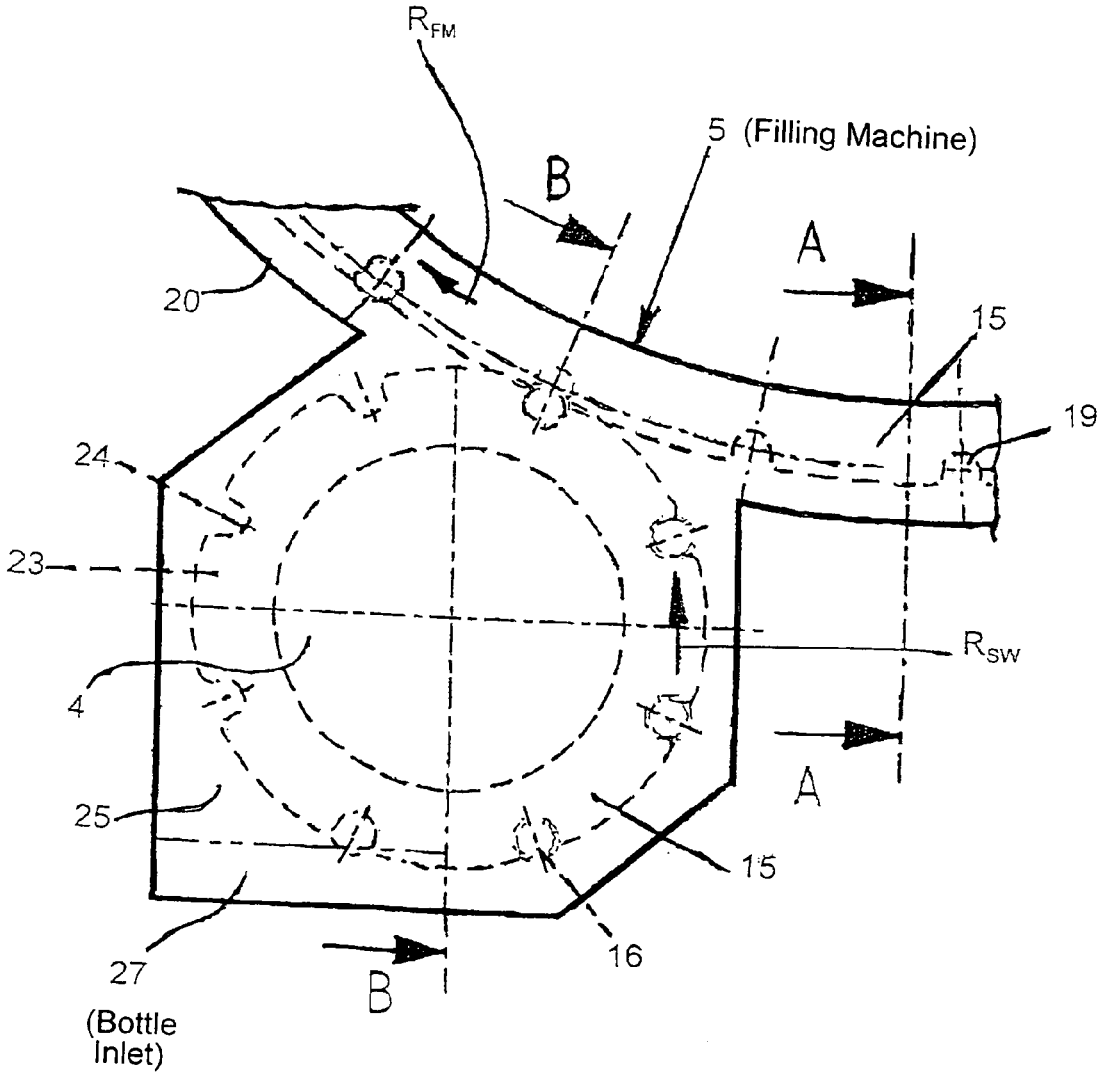
FIG. 4A is a view similar to FIG. 4 drawn to a larger scale and including identification of further detail.
Figure 3:
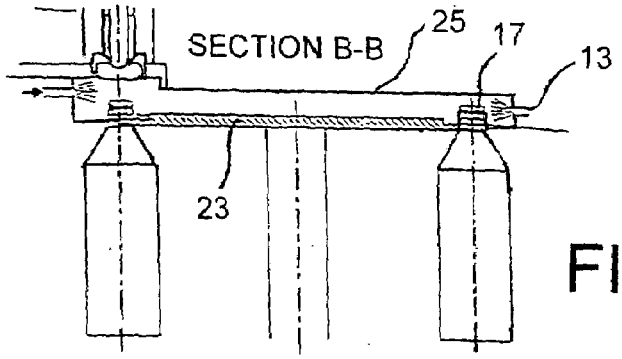
FIG. 3 is a cross-section along line B—B in FIG. 4.
Figure 4:
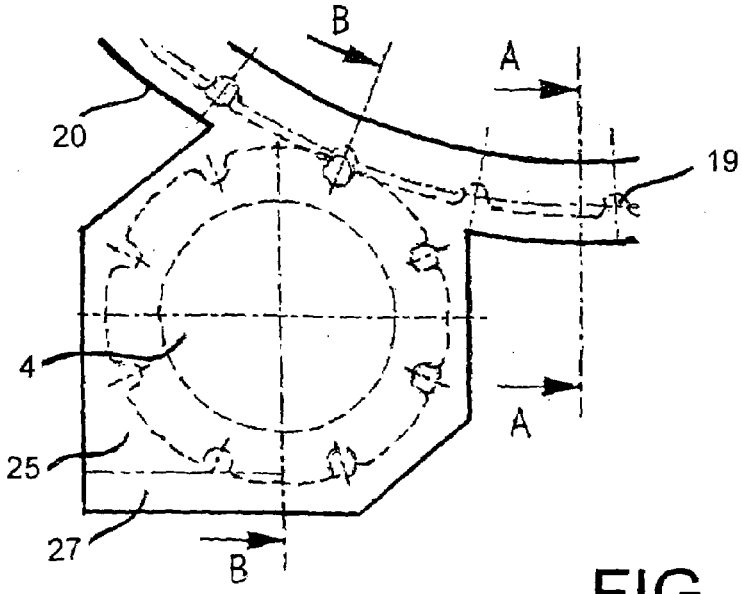
FIG. 4 is a top plan view of the enclosed region of an input star conveyer to feed bottles to the filling machine.

In accordance with the embodiment of FIG. 3 and FIG. 4, the stars are provided by a flat disc 23 with corresponding recesses, supports, and/or centering structures 24. These discs are enveloped by a stationary upper hood component 25 whereby the rotating disc surface provides the lower limit of the chamber. For introduction and removal of the mouth in the transfer region of the filling machine 5, and the like equipment, there can be provided transfer devices, cover sheets 26, and the like transfer elements, or arrangements to move bottle from the star wheel recess 24 to the filling machine recess 19, as is illustrated by way of an input embodiment in FIG. 4 and FIG. 4A.

The container mouths are possibly introduced at a narrow entrance opening and exit opening 27 of the star pockets, or, respectively, the centering devices 24, or, respectively, removed from these upon completion of processing. For introduction of the sterile medium, inlets, or nozzles 13 can be provided at various locations, so as to maintain a rather constant and a rather all-pervasive low over-pressure in the clean chamber 15. However, it is within the scope of the various embodiments to carry out the introduction of the sterile medium at the container input side, whereby this sterile medium, or, respectively, a portion thereof, flows through the clean chamber 15 in the direction of rotation of the equipment while utilizing the rotational flow, compare arrow $R_{FM}$ and arrow $R_{SW}$, in FIGS. 4A and 6A.

In accordance with the embodiment illustrated in FIG. 6, the supports, and/or the centering devices 24 that carry the mouths 17, or, respectively, the regions thereof, can be hingedly disposed, for example, to be swung in outward direction, or in downward direction. For this, the corresponding hinge mechanism 25 can be held with torsion springs 27 at rotary hinges 26. In other words, FIG. 5A suggest a hinge 28*a*, as is well known, and a biasing element, such as, a spring 28*b*, as is well known for spring-biased hinge arrangements, for example, a torsion spring, forming part of a release mechanism or arrangement 28 having components 28' and 28" for bottles 16 that may need to be removed in downward direction $D_B$ upon a operating and/or system failure in the filling process. There may also be provided a stop arrangement 32.

In the case where the containers 16 are introduced from below in upward direction in the manner as is done in known filling machines that employ lifting elements, there are possibly provided openings at the lower side of the clean chamber. Movement of a bottle 16 into the corresponding opening, say slot 46 in FIG. 2B of this application, may be with play or without play. Flexible openings or retainers 19*a* and a lifting device 50 are illustrated in FIG. 5B of this application. In this way, the mouth portion 17 of a bottle 16 is introduced from below into the clean chamber 15 and is then surrounded in the chamber 15 by a disinfecting medium.

The bottles 16 may be introduced by lifting devices 50 which are well known in the art, from below into the clean room or chamber 15.

In other words, a container filling machine 5 may possibly of a design of a rotating machine that has a plurality of filling elements or filling valves 30 the rotor 105'. Support plates or support tables that can be raised and lowered at the filling positions 113 are associated with the filling elements or valves 30, which support tables, for example carriers 113*a*, receive the containers 16 that are to be filled via input star wheels, for example transport star 4.

Further, a lifting device such as 50, that also lowers a container 16, is associated with each of these support tables, generally identified by reference numeral 113*a*, has the purpose of raising the containers 16 that are disposed on the support tables or carriers 113*a* towards the filling devices or valves 30 and to press the containers 16 against the filling valves 30. In order to accomplish this function, these lifting devices may possibly comprise a combination of a fixed piston and a moveably disposed cylinder structure that surrounds the piston. The structural components are disposed vertically, and with the piston being rigidly connected to the rotor of the container filling machine 5. The cylinder can be moved up and down in a vertical direction. The cylinder chamber or cavity that is established between the fixed piston and the moveable cylinder, is in most cases operated by compressed air, the compressed air being passed through a bore within the piston, such that the cylinder is moved in a vertical direction to an upper position. This movement may possibly be limited by a roller that is secured to the cylinder, which roller is configured to rotate about its longitudinal axis, with the roller contacting a curved stationary cam structure. By way of the rotating movement of the rotor of the container filling machine, the roller rolls upon the curved path of the cam structure, that is, it follows the course of the curved cam structure and simultaneously carries out an upwardly directed movement and a corresponding downwardly directed movement, which movements, due to the configuration of the design of the machine 5, are also carried out by the support table 113*a* and, accordingly, a container 16 supported on a support table 113*a*.

The curved path of such cam structures is not disposed along the entire circumferential surface area or region of the rotor 105', but they rather extend only along a portion of the circumference, possibly in the region of the container inlet and the container outlet, where the receiving surface of the support table 113*a* needs to be disposed at the level of the transport structures that supply containers 16 and also remove containers 16.

Figure 6A:
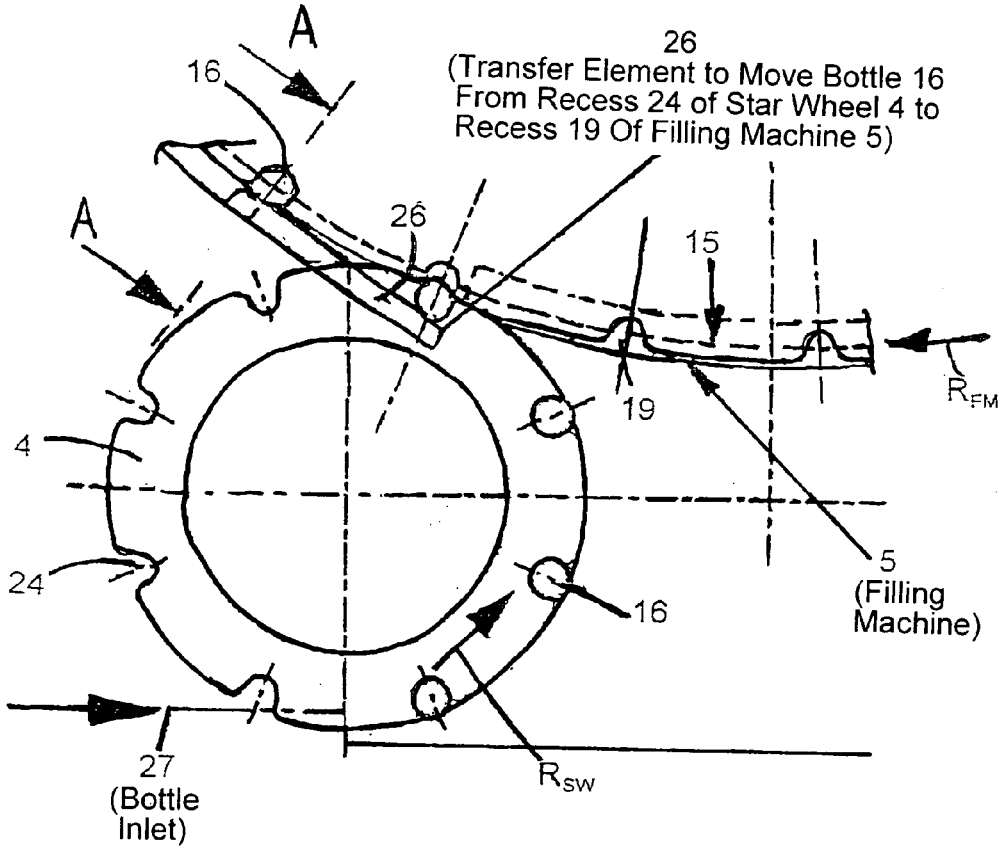
FIG. 6A is a view similar to FIG. 6 drawn to a larger scale and including identification of further detail.

Thus, in the described embodiments, see, for example FIG. 1A of the present application, downstream of rinser station 3, in the direction of travel as is indicated by the arrow A, the rinsed bottles 16 are transported to beverage filling machine 5 by means of conveyer line or conveyer arrangement 4 that is formed, for example, by a star wheel conveyer or a plurality of star wheels of a conveyer arrangement as is known in the art. The conveyer arrangement 4 may possibly have a star wheel that introduces bottles 16 into the filling machine 5 with a transfer element 26 being possibly employed as is schematically indicated in FIG. 6 and FIG. 6A of the present application.

One feature or aspect of an embodiment is believed at the time of the filing of this patent application to possibly reside broadly in a container handling machine for handling beverage containers, such as, bottles and the like, the machine comprising a carousel that rotates about a vertical axis, the carousel comprising handling positions that are disposed at a distance from one another and that are configured to hold the beverage containers, whereby the handling positions are disposed in a substantially closed chamber that is supplied with a special atmosphere, the chamber comprising rotatable chamber components and chamber components that are fixed relative thereto, characterized in that that this chamber 15 embraces only a portion of the beverage containers 16 at least the mouth portions 17 of the beverage containers.

Another feature or aspect of an embodiment is believed at the time of the filing of this patent application to possibly reside broadly in a container handling machine characterized in that at least a portion of the container 16 that is disposed away from the mouth portion and/or the centering device thereof is disposed to remain outside of the clean chamber 15.

Yet another feature or aspect of an embodiment is believed at the time of the filing of this patent application to possibly reside broadly in a container handling machine characterized in that at least one wall that defines the clean chamber 15 and that moves with the rotating carousel comprises the holder and/or the support and the centering device 24 for the mouth portion 17 of the beverage containers 16 and/or supports such components.

Still another feature or aspect of an embodiment is believed at the time of the filing of this patent application to possibly reside broadly in a container handling machine characterized in that the holder and/or the support and the centering device 24 for the beverage containers 16 and/or the mouth portions 17 thereof are configured by recesses 24 in the lower space-defining wall/wall surface 18 that moves with the rotating carousel.

A further feature or aspect of an embodiment is believed at the time of the filing of this patent application to possibly reside broadly in a container handling machine characterized in that the input and output star discs 4, 8, 23 of the rotating handling machine configure the lower space-defining wall of the clean chamber 15 and that these discs are surrounded by a fixed upper hood portion 25.

Another feature or aspect of an embodiment is believed at the time of the filing of this patent application to possibly reside broadly in a container handling machine characterized in that the holders and/or the supports and centering devices 24 for the mouth of the containers 16 are configured at least at the input und output locations to be swung away at such locations.

Yet another feature or aspect of an embodiment is believed at the time of the filing of this patent application to possibly reside broadly in a container handling machine characterized in that the holders and/or supports and centering devices 24 are configured to be swung away in downwardly direction by means of a rotary linkage 26 and under spring bias 27.

Still another feature or aspect of an embodiment is believed at the time of the filing of this patent application to possibly reside broadly in a container handling machine characterized in that the seal between the rotatable and fixedly-disposed portion of the clean chamber 15 is configured by one annular gap or by a plurality of annular gaps.

A further feature or aspect of an embodiment is believed at the time of the filing of this patent application to possibly reside broadly in a container handling machine characterized in that the input of sterile gas is carried at the container input location and that the sterile gas can be removed at the container output location under utilization of the rotational flow in the clean chamber 15 in the direction of rotation.

Another feature or aspect of an embodiment is believed at the time of the filing of this patent application to possibly reside broadly in a container handling machine characterized in that in the case that container mouths can be introduced from below to above against the filling valves, the clean chamber 15 comprises openings for the container mouths 17 which openings comprise openings that can be controlled/approached and/or flexible openings.

Some examples of bottling systems that may possibly be utilized or possibly adapted for use in at least one possible embodiment of the present application may possibly be found in the following U.S. Patents, all assigned to the Assignee herein, namely: U.S. Pat. No. 4,911,285; U.S. Pat. No. 4,944,830; U.S. Pat. No. 4,950,350; U.S. Pat. No. 4,976,803; U.S. Pat. No. 4,981,547; U.S. Pat. No. 5,004,518; U.S. Pat. No. 5,017,261; U.S. Pat. No. 5,062,917; U.S. Pat. No. 5,062,918; U.S. Pat. No. 5,075,123; U.S. Pat. No. 5,078,826; U.S. Pat. No. 5,087,317; U.S. Pat. No. 5,110,402; U.S. Pat. No. 5,129,984; U.S. Pat. No. 5,167,755; U.S. Pat. No. 5,174,851; U.S. Pat. No. 5,185,053; U.S. Pat. No. 5,217,538; U.S. Pat. No. 5,227,005; U.S. Pat. No. 5,413,153; U.S. Pat. No. 5,558,138; U.S. Pat. No. 5,634,500; U.S. Pat. No. 5,713,403; U.S. Pat. No. 6,276,113; U.S. Pat. No. 6,213,169; U.S. Pat. No. 6,189,578; U.S. Pat. No. 6,192,946; U.S. Pat. No. 6,374,575; U.S. Pat. No. 6,365,054; U.S. Pat. No. 6,619,016; U.S. Pat. No. 6,474,368; U.S. Pat. No. 6,494,238; U.S. Pat. No. 6,470,922; U.S. Pat. No. 6,463,964;

U.S. Pat. No. 6,470,922; U.S. Pat. No. 6,474,368; U.S. Pat. No. 6,484,477; U.S. Pat. No. 6,494,238; and U.S. Pat. No. 6,619,016.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of lifting devices that may possibly be utilized or possibly adapted for use in at least one possible embodiment of the present application may possibly be found in the following patent publications: British Patent No. 1,188,888 issued Apr. 22, 1970; German Laid Open Patent Application No. DE-OS 26 52 910 published on May 24, 1978; German Patent No. DE-PS 26 52 918 issued on Oct. 26, 1978; German Utility Model No. DE-GM 83 04 995 issued on Dec. 22, 1983; German Patent No. DE-PS 26 30 100 issued on Dec. 3, 1981; and German Laid Open Patent Application No. DE-OS 195 45 080 published on Jun. 5, 1997.

The following co-pending U.S. patent application Ser. No. 10/786,256, filed on Feb. 25, 2004, having the title: A beverage bottling plant for filling bottles with a liquid beverage filling material, and a container filling lifting device for pressing containers to container filling machines, having inventor Herbert BERNHARD, and having NHL-HOL-66, is hereby incorporated by reference as if set forth in its entirety herein.

The following co-pending U.S. patent application Ser. No. 10/813,651 filed on Mar. 30, 2004, having the title: A beverage bottling plant for filling bottles with a liquid beverage filling material, and an easily cleaned lifting device in a beverage bottling plant, having inventor Herbert BERNHARD, and having NHL-HOL-67, is hereby incorporated by reference as if set forth in its entirety herein.

The appended drawings in their entirety, including all dimensions, proportions and/or shapes in at least one embodiment of the invention, are accurate and are hereby included by reference into this specification.

Some examples of timer apparatus that may possibly be utilized or possibly adapted for use in at least one possible embodiment of the present application may possibly be found in the following U.S. Pat. No. 5,910,739 issued to Stanojevic on Jun. 8, 1999; U.S. Pat. No. 5,999,087 issued to Gunton on Dec. 7, 1999; U.S. Pat. No. 6,016,531 issued to Rixner et al. on Jan. 18, 2000; U.S. Pat. No. 6,020,697 issued to Stenger et al. on Feb. 1, 2000; U.S. Pat. No. 6,020,775 issued to Chevallier on Feb. 1, 2000; and U.S. Pat. No. 6,038,197 issued to Phillips on Mar. 14, 2000.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner or should not be interpreted as limiting the claims in any manner.

Some examples of computer systems that may possibly be utilized or possibly adapted for use in at least one possible embodiment of the present application may possibly be found in the following U.S. Pat. No. 5,416,480 issued to Roach et al. on May 16, 1995; U.S. Pat. No. 5,479,355 issued to Hyduke on Dec. 26, 1995; U.S. Pat. No. 5,481,730 issued to Brown et al. on Jan. 2, 1996; U.S. Pat. No. 5,805,094 issued to Roach et al. on Sep. 8, 1998; U.S. Pat. No. 5,881,227 issued to Atkinson et al. on Mar. 9, 1999; and U.S. Pat. No. 6,072,462 issued to Moshovich on Jun. 6, 2000.

All, or substantially all, of the components and methods of the various embodiments may be used with at least one embodiment or all of the embodiments, if more than one embodiment is described herein.

Some examples of sensors that may possibly be utilized or possibly adapted for use in at least one possible embodiment of the present application may possibly be found in the following U.S. Pat. No. 6,062,248 issued to Boelkins on May 16, 2000; U.S. Pat. No. 6,223,593 issued to Kubisiak et al. on May 1, 2001; U.S. Pat. No. 6,466,035 issued to Nyfors et al. on Oct. 15, 2002; U.S. Pat. No. 6,584,851 issued to Yamagishi et al. on Jul. 1, 2003; U.S. Pat. No. 6,631,638 issued to James et al. on Oct. 14, 2003; and U.S. Pat. No. 6,707,307 issued to McFarlane et al. on Mar. 16, 2004.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner. Thus, in one aspect, commencing from the solutions known in the art, it is an object of the present application to restrict the handling space that is configured as clean room or clean space or clean chamber to the essential volume.

An example of a rotary distributor that may possibly be utilized or possibly adapted for use in at least one possible embodiment of the present application may possibly be found in German Utility Model DE-GM No. 296 20 323 U1 published on Mar. 6, 1997.

All of the patents, patent applications and publications recited herein, and in the Declaration attached hereto, are hereby incorporated by reference as if set forth in their entirety herein.

Some examples of seal arrangements that may possibly be utilized or possibly adapted for use in at least one possible embodiment of the present application may possibly be found in the following U.S. Pat. No. 4,010,960 issued to Martin on Mar. 8, 1977; U.S. Pat. No. 5,411,273 issued to Pietsch et al. on May 2, 1995; U.S. Pat. No. 5,375,852 issued to Charhut on Dec. 27, 1994; U.S. Pat. No. 6,189,896 issued to Dickey et al. on Feb. 20, 2002: U.S. Pat. No. 6,692,007 issued to Oldenburg on Feb. 17, 2004; and U.S. Pat. No. 6,648,335 issued to Ezell on Nov. 18, 2003.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

Some examples of container processing apparatus that may possibly be utilized or possibly adapted for use in at least one possible embodiment of the present application may possibly be found in the following U.S. Pat. No. 4,241,848 issued to Young on Dec. 30, 1980; U.S. Pat. No. 4,382,422 issued to Eddy et al. on May 10, 1983; and U.S. Pat. No. 4,720,797 issued to Sommerfield et al. on Jan. 19, 1988.

The corresponding foreign patent application and patent publication, namely, Federal Republic of Germany Patent Application No. P 103 26 618.6, filed on Jun. 13, 2003, having inventor Volker TILL, and Federal Republic of Germany patent publication No. DE-OS 103 26 618.6, having inventor Volker TILL, and Federal Republic of Germany patent publication No. DE-PS 103 26 618.6, having inventor Volker TILL, as well as their published equivalents, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

One example of an immersion bath sterilizer that may possibly be utilized or possibly adapted for use in at least one possible embodiment of the present application may possibly be found in U.S. Pat. No. 6,185,910 issued to Achhammer on Feb. 13, 2001.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

Some examples of plasma disinfecting equipment that may possibly be utilized or possibly adapted for use in at least one possible embodiment of the present application may possibly be found in the following U.S. Pat. No. 5,635,059 issued to Johnson on Jun. 3, 1997; U.S. Pat. No. 5,792,369 issued to Johnson on Aug. 11, 1998; and U.S. Pat. No. 6,054,097 issued to Mass et al. on Apr. 25, 2000.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72(b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The application, in one aspect, relates to a container handling machine for handling beverage containers, such as, bottles and the like, the machine comprising a carousel that rotates about a vertical axis, the carousel comprising handling positions that are disposed at a distance from one another and that are configured to hold the beverage containers, whereby the handling positions are disposed in a substantially closed chamber that is supplied with a special atmosphere, the chamber comprising rotatable chamber components and chamber components that are fixed relative thereto.

The application relates, in one aspect, to a beverage container handling machine for beverage containers, such as, bottles and the like, with a carousel that rotates about a vertical axis and the carousel comprising handling positions that are disposed at a distance from one another and that are configured for the holder of the beverage containers, whereby the handling positions are disposed in a substantially closed space that is impacted with a special atmosphere, the space being confined by rotatable components defining the space and by fixed components defining the space, and is characterized in this space 15 embraces only a portion of the beverage containers 16 at least the mouth portion 17 of the beverage containers.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL LIST OR REFERENCE NUMBERS

Figure 5A:
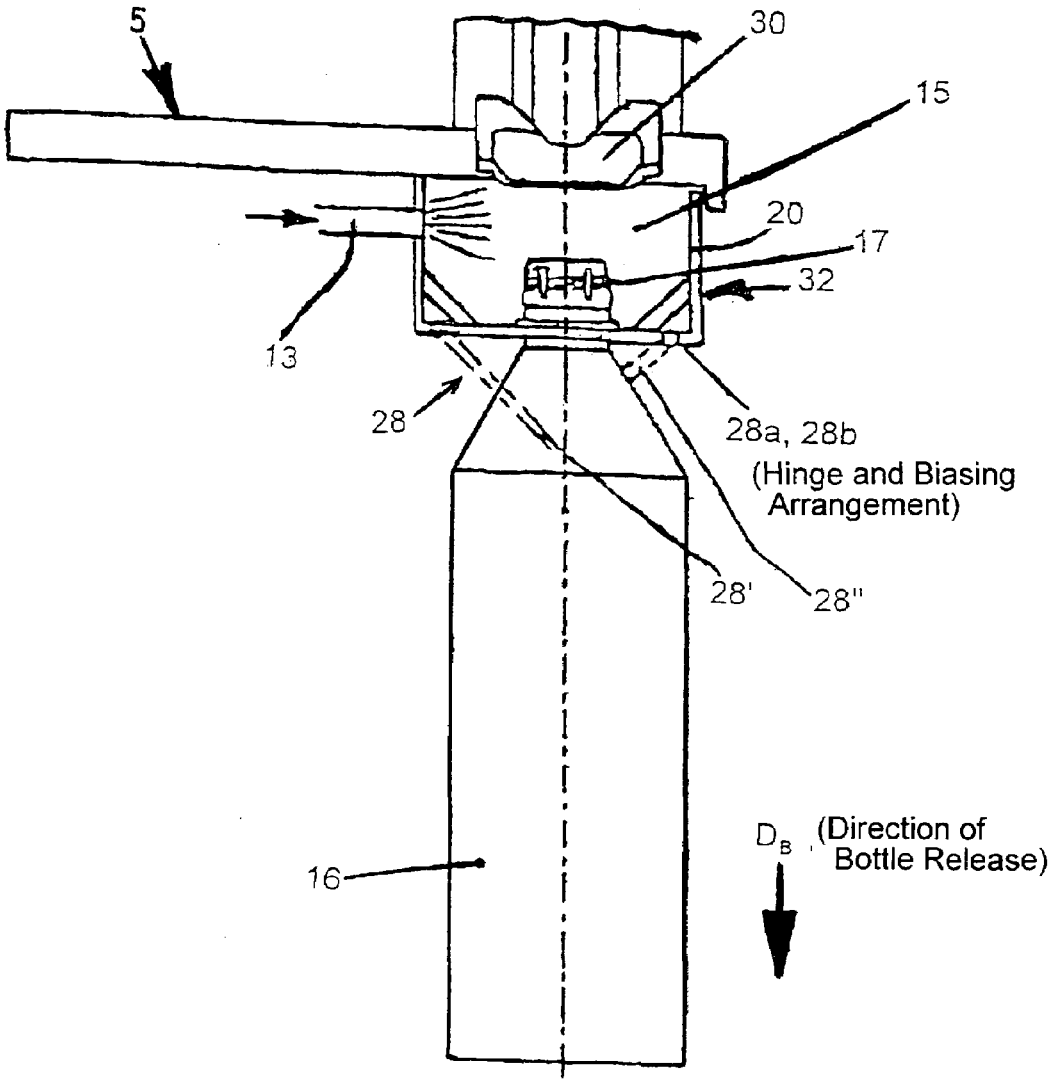
FIG. 5A is a view similar to FIG. 5 drawn to a larger scale and including identification of further detail.
Figure 5B:
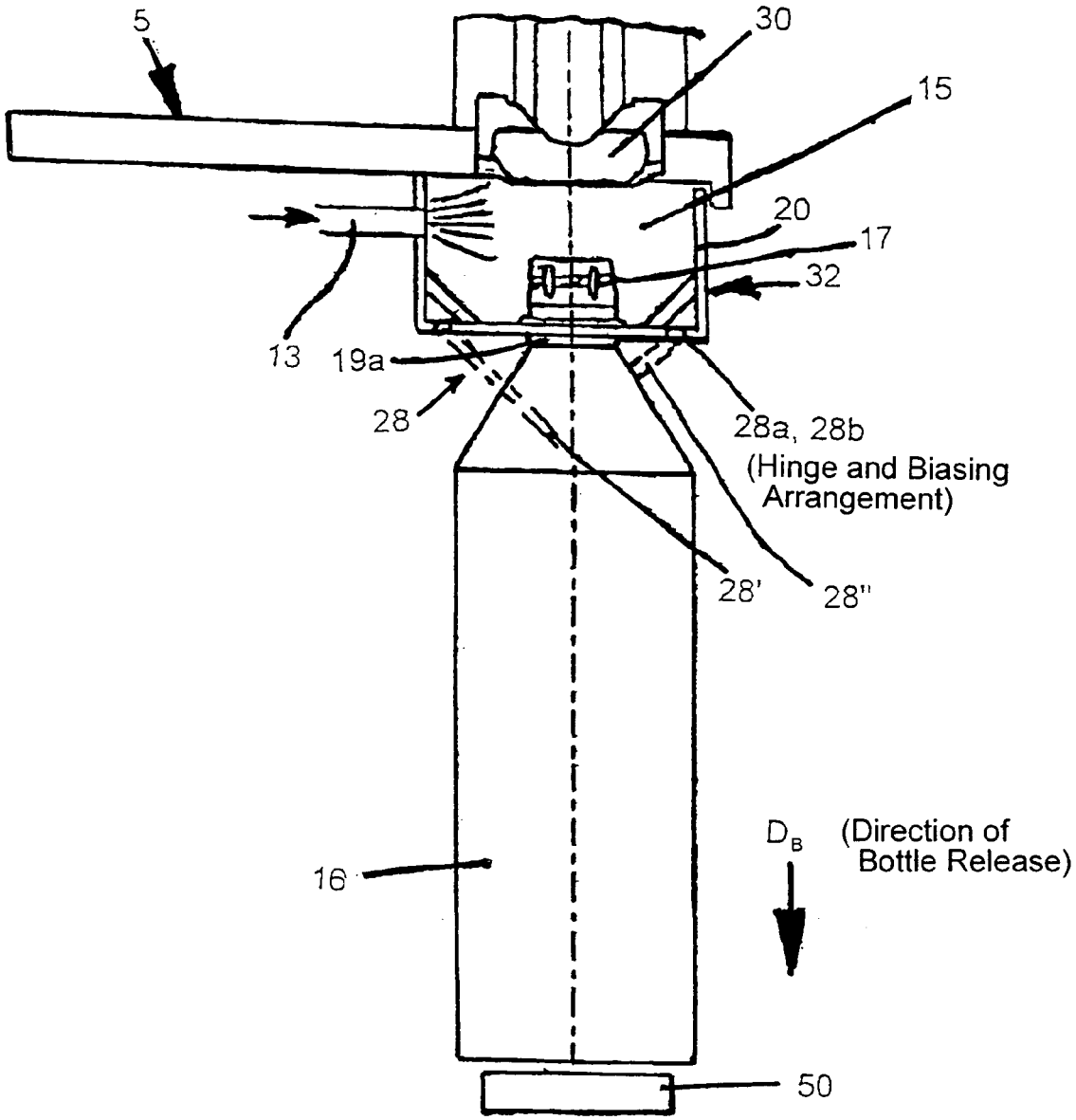
FIG. 5B is a view similar to FIG. 5 and including identification of further detail.

1 Dividing screw
2 Transport star—conveyer to feed bottles to rinser
3 Rinser, rinser station
4 Transport star—conveyer to pass bottles to filling machine
5 Beverage filling machine, filler
5*a* surface in FIG. 2B
6 Transport star—conveyer from filling machine/filler to closer
7 Closer, closer station
8 Transport star—conveyer to feed bottles from closer
9 Conveyer to feed bottles to labeling station
10 Enclosure for filling machine
11 Annular channel
12 Gap
13 Conduit—input (nozzle)
14 Gap narrow
15 Chamber, clean room
16 Container, bottle
17 Mouth/neck portion of container
18 Wall horizontal, revolving component
18*a* Vertical wall—revolving/rotating
19 Holder, support, centering arrangement/device
19*a* Flexible holder in chamber
20 Clean room or chamber—stationary portion
21 Wall outer, stationary component
21*a* Wall surface
21*b* Wall portion
21*c* Groove in 21
22 Centering wall
23 Disc—flat
23*a* Shaft to rotate disc 23
24 Recesses, supports, and/or centering 26 arrangements of stars
25 Hood upper stationary, cover sheet
26 Transfer element, arrangement—to move bottle from star wheel recess to filling machine recess
27 Inlet/outlet opening
28 Release mechanism, arrangement
28' Release portion
28" release portion
28*a* Hinge
28*b* Spring, biasing member, torsion spring
30 Filling valve
32 Stop arrangement in FIG. 5 and FIG. 5A
40 Seal location
42 Seal location
44 Seal location
46 Slot for bottle neck
48 Cover for slot 46
50 Lifting device
100 Beverage bottling plant
105' Rotor
108 Labeling station, labeling device
108*a* Labeling module for first product
108*b* Labeling module for second product
108*c* Inspecting station or module
109 Conveyer to output first product containers
110 Conveyer arrangement to output second product containers
111 Conveyer arrangement to output incorrectly labeled containers
112 Central control unit, controller
113 Filling positions
113*a* Container carriers/bottle carriers
114 Filling device, element, apparatus
117 Toroidal vessel
121 Conduit for first product
122 Conduit for second product
123 A First product mixer
124 Second product mixer
A Direction of travel of bottles
$D_B$ Direction of bottle from filling machine
$R_{FM}$ Direction of rotation of filling machine
$R_{SW}$ Direction of rotation of star wheel

What is claimed is:

1. A beverage bottling plant for filling bottles with a liquid beverage filling material, said beverage bottling plant comprising:

a bottle cleaning station being configured and disposed to clean bottles with a cleaning fluid;

said bottle cleaning station comprising a rotatable structure;

a conveyer arrangement being configured and disposed to move bottles into said rotatable bottle cleaning station;

a storage apparatus being configured and disposed to store a liquid beverage filling material;

a beverage filling machine being configured and disposed to fill empty bottles with liquid beverage filling material;

a conduit arrangement being configured and disposed to supply liquid beverage filling material from said storage apparatus to said beverage filling machine;

said beverage filling machine comprising a rotatable structure;

said rotatable beverage filling machine also comprising a plurality of beverage filling stations, each beverage filling station comprising a beverage filling device for filling bottles with liquid beverage filling material;

said filling devices comprising apparatus being configured to introduce a predetermined volume of liquid beverage filling material into interiors of bottles to a substantially predetermined level of liquid beverage filling material and to terminate the filling of beverage bottles upon liquid beverage filling material reaching said substantially predetermined level in bottles;

a conveyer arrangement being configured and disposed to move empty bottles from said rotatable bottle cleaning station into said rotatable beverage filling machine;

a closing station being configured and disposed to secure bottle caps to bottles to be closed;

said bottle closing station comprising a rotatable structure;

a conveyer arrangement being configured and disposed to move filled bottles from said rotatable beverage filling machine into said rotatable closing station;

said rotatable cleaning station comprising:

a chamber being configured and disposed to confine the top of each bottle being processed and also being configured to dispose the lower portion of each bottle, having its top confined, outside said chamber;

an arrangement being configured and disposed to provide a disinfecting environment in said chamber to disinfect solely the tops of the bottles being processed; and the top of each bottle including the mouth portion and at least a portion of the neck portion of each bottle being processed;

said rotatable beverage filling machine comprising:

a chamber being configured and disposed to confine the top of each bottle being processed and also being configured to dispose the lower portion of each bottle, having its top confined, outside said chamber; and an arrangement being configured and disposed to provide a disinfecting environment in said chamber to disinfect solely the tops of the bottles being processed;

said conveyer arrangement for moving bottles from said rotatable bottle cleaning station into said rotatable beverage filling machine comprising:

a chamber being configured and disposed to confine the top of each bottle being processed and also being configured to dispose the lower portion of each bottle, having its top confined, outside said chamber; and an arrangement being configured and disposed to provide a disinfecting environment in said chamber to disinfect solely the tops of the bottles being processed;

said rotatable bottle closing station comprising:

a chamber being configured and disposed to confine the top of each bottle being processed and also being configured to dispose the lower portion of each bottle, having its top confined, outside said chamber; and an arrangement being configured and disposed to provide a disinfecting environment in said chamber to disinfect solely the tops of the bottles being processed;

said conveyer arrangement for moving filled bottles from said rotatable beverage filling machine into said rotatable bottle closing station comprising:

a chamber being configured and disposed to confine the top of each bottle being processed and also being configured to dispose the lower portion of each bottle, having its top confined, outside said chamber; and said beverage bottling plant further comprising:

a conveyer arrangement being configured and disposed to move bottles from said rotatable bottle closing station.

2. The beverage bottling plant according to claim 1, wherein:

at least one of said chambers comprises a vertical axis, a first set of wall components being configured and disposed to rotate about the vertical axis, and a second set of wall components being stationary and non-rotatable; and at least one of: said rotatable cleaning station, said rotatable beverage filling machine, said conveyer arrangement for moving bottles from said rotatable cleaning station into said rotatable beverage filling machine, said rotatable bottle closing station, and said conveyer arrangement for moving filled bottles between said rotatable beverage filling machine and said rotatable closing station comprises:

supporting and holding arrangements being disposed in said at least one chamber, being disposed at a distance from one another, being configured to be rotatable about the vertical axis, and being configured to hold bottles being processed;

said rotatable set of wall components comprises at least one rotatable wall;

each said at least one rotatable wall comprising at least one of: a holder for holding the top of a bottle being processed, a support device for supporting the top of a bottle being processed, a centering device for centering the top of a bottle being processed, a first support arrangement for supporting said holder, a second support arrangement for supporting said support device, and a third support arrangement for supporting said centering device;

at least one of: said holder, said support device, and said centering device comprises a recess;

said rotatable set of wall components comprises at least one bottom wall being configured and disposed to rotate about the vertical axis;

said recess is disposed in said bottom wall;

each one of said conveyer arrangements comprises a star wheel conveyer arrangement;

each one of said star wheel conveyer arrangements forms at least a portion of its corresponding chamber bottom wall; and a stationary upper hood structure being configured and disposed to surround its corresponding star wheel conveyer arrangement.

3. The beverage bottling plant according to claim 2, wherein:

each one of said star wheel conveyer arrangements comprises an input station and an output station;

at least one of: said holder, said support device, and said centering device is configured, at least at one of said input station and said output station, to be swung away from its corresponding input station and its corresponding output station;

at least one of: said holder, said support device, and said centering device comprises:

an arrangement being configured and disposed to pivot a portion of at least one of: said holder, said support device, and said centering device;

an arrangement being configured and disposed to bias said pivotable arrangement in a first direction;

said first set of rotatable wall components comprises a first rotatable wall;

said second set of stationary wall components comprises a first stationary wall;

a seal arrangement being disposed between said first rotatable wall and said first stationary wall;

said at least one chamber comprises an arrangement being configured and disposed to introduce a disinfecting medium free of microorganisms at its corresponding conveyer input station;

said at least one chamber comprises an arrangement being configured and disposed to remove a disinfecting medium at its corresponding conveyer output station;

said at least one chamber being configured and disposed to permit rotational flow of a disinfecting medium in said at least one chamber; and said at least one chamber comprises at least one of: (a) and (b), wherein (a) and (b) comprise:

(a) a structure having an opening;

said opening being configured and disposed to permit introduction of the top of a bottle into said at least one chamber without play into said chamber and also being configured and disposed to permit positioning of the top of a bottle against its corresponding filling device of said beverage filling machine; and (b) a structure having an opening;

said opening being configured and disposed to permit introduction of the top of a bottle into said at least one chamber with play into said chamber and also and also being configured and disposed to permit positioning of the top of a bottle against its corresponding filling device of said beverage filling machine.

4. In a container filling plant for filling containers with a liquid beverage filling material, said container filling plant comprising:

a container filling machine being configured and disposed to fill empty containers with liquid beverage filling material;

said beverage filling machine comprising a storage apparatus being configured and disposed to store a liquid beverage filling material and also comprising a plurality of beverage filling stations, each beverage filling station comprising a beverage filling device for filling containers with liquid beverage filling material;

said filling devices comprising apparatus being configured to introduce a predetermined volume of liquid beverage filling material into the interior of containers;

a conveyer arrangement being configured and disposed to move empty containers into said beverage filling machine;

a closing station being configured and disposed to close top portions of containers;

a conveyer arrangement being configured and disposed to move filled containers between said beverage filling machine and said closing station;

at least one of: said beverage filling machine, said conveyer arrangement for moving containers into said beverage filling machine, said container closing station, and said conveyer arrangement for moving filled containers between said beverage filling machine and said closing station comprising;

a chamber being configured and disposed to at least partially enclose solely the top portions of containers being processed; and an arrangement being configured and disposed to provide a disinfecting environment in said chamber to disinfect solely the top portions of containers being processed;

at least one hood structure being configured and disposed to surround a corresponding conveyer arrangement;

each one of said conveyer arrangements comprises a star wheel conveyer arrangement;

each one of said star wheel conveyer arrangements forms at least a portion of its corresponding chamber bottom wall; and said at least one hood structure comprises a stationary upper hood structure.

5. In a container filling plant according to claim 4, wherein:

said at least one chamber comprises a vertical axis, a first set of wall components being configured and disposed to rotate about the vertical axis, and a second set of wall components being stationary and non-rotatable; and at least one of: said beverage filling machine, said conveyer arrangement for moving containers into said beverage filling machine, said container closing station, and said conveyer arrangement for moving filled containers between said beverage filling machine and said closing station comprises:

supporting and holding arrangements being disposed in said at least one chamber, being disposed at a distance from one another, being configured to be rotatable about the vertical axis, and being configured to hold containers being processed.

6. In a container filling plant according to claim 5, wherein:

said rotatable set of wall components comprises at least one rotatable wall; and each said at least one rotatable wall comprising at least one of: a holder for holding the top portion of a container being processed, a support device for supporting the top portion of a container being processed, a centering device for centering the top portion of a container being processed, a first support arrangement for supporting said holder, a second support arrangement for supporting said support device, and a third support arrangement for supporting said centering device.

7. In a container filling plant according to claim 6, wherein:

at least one of: said holder, said support device, and said centering device comprises a recess;

said rotatable set of wall components comprises at least one bottom wall being configured and disposed to rotate about the vertical axis; and said recess is disposed in said bottom wall.

8. In a container filling plant according to claim 7, wherein:

each one of said star wheel conveyer arrangements comprises an input station and an output station; and at least one of: said holder, said support device, and said centering device is configured, at least at one of said input station and said output station, to be swung away from its corresponding input station and its corresponding output station.

9. In a container filling plant according to claim 8, wherein:

at least one of: said holder, said support device, and said centering device comprises:

an arrangement being configured and disposed to pivot a portion of at least one of: said holder, said support device, and said centering device; and an arrangement being configured and disposed to bias said pivotable arrangement in a first direction.

10. In a container filling plant according to claim 9, wherein:

said first set of rotatable wall components comprises a first rotatable wall;

said second set of stationary wall components comprises a first stationary wall; and a seal arrangement being disposed between said first rotatable wall and said first stationary wall.

11. In a container filling plant according to claim 10, wherein:

said at least one chamber comprises an arrangement being configured and disposed to introduce a disinfecting medium free of microorganisms at its corresponding conveyer input station;

said at least one chamber comprises an arrangement being configured and disposed to remove a disinfecting medium at its corresponding conveyer output station;

said at least one chamber being configured and disposed to permit rotational flow of a disinfecting medium in said at least one chamber;

said at least one chamber comprises at least one of: (a) and (b), wherein (a) and (b) comprise:

(a) a structure having an opening;

said opening being configured and disposed to permit introduction of the top of a container into said at least one chamber without play into said chamber and also being configured and disposed to permit positioning of the top of a container against its corresponding filling device of said beverage filling machine; and (b) a structure having an opening;

said opening being configured and disposed to permit introduction of the top of a container into said at least one chamber with play into said chamber and also and also being configured and disposed to permit positioning of the top of a container against its corresponding filling device of said beverage filling machine.

12. A method of operating a container filling plant for filling containers, said container filling plant comprising:

a filling machine being configured and disposed to fill empty containers with filling material;

said filling machine comprising a plurality of filling stations, each said filling station comprising a filling device for filling containers with a filling material;

a conveyer arrangement being configured and disposed to move empty containers into said filling machine;

a closing station being configured and disposed to close top portions of containers;

a conveyer arrangement being configured and disposed to move filled containers between said filling machine and said closing station;

at least one of: said filling machine, said conveyer arrangement for moving containers into said filling machine, said container closing station, and said conveyer arrangement for moving filled containers between said filling machine and said closing station comprising:

a chamber being configured and disposed to at least partially enclose solely the top portions of containers being processed; and an arrangement being configured and disposed to provide a disinfecting environment in said chamber to disinfect solely the top portions of containers being processed;

said at least one chamber comprises a vertical axis, and a first set of wall components being configured and disposed to rotate about the vertical axis, and also a second set of wall components being stationary and non-rotatable;

at least one of: said filling machine, said conveyer arrangement for moving containers into said filling machine, said container closing station, and said conveyer arrangement for moving filled containers between said filling machine and said closing station comprises:

supporting and holding arrangements being disposed in said at least one chamber, being disposed at a distance from one another, being configured to be rotatable about the vertical axis, and being configured to hold containers being processed;

said rotatable set of wall components comprises at least one rotatable wall;

each said at least one rotatable wall comprising at least one of: a holder for holding the top portion of a container being processed, a support device for supporting the top portion of a container being processed, a centering device for centering the top portion of a container being processed, a first support arrangement for supporting said holder, a second support arrangement for supporting said support device, and a third support arrangement for supporting said centering device;

at least one of: said holder, said support device, and said centering device comprises a recess;

said rotatable set of wall components comprises at least one bottom wall being configured and disposed to rotate about the vertical axis;

said recess is disposed in said bottom wall;

each one of said conveyer arrangements comprises a star wheel conveyer arrangement;

each one of said star wheel conveyer arrangements forms at least a portion of its corresponding chamber bottom wall; and a stationary upper hood structure being configured and disposed to surround its corresponding star wheel conveyer arrangement;

said method comprising the steps of:

introducing a disinfectant, with said arrangement for providing a disinfecting environment, into said at least one chamber to disinfect solely the top portions of containers being processed;

moving disinfectant in at least a portion of said at least one chamber about the top portions of containers being processed; and rotating said first said of wall components of said at least one chamber about the vertical axis.

13. The method of operating a container filling plant according to claim 12, wherein:

each one of said star wheel conveyer arrangements comprises an input station and an output station;

at least one of: said holder, said support device, and said centering device is configured, at least at one of said input station and said output station, to be swung away from its corresponding input station and its corresponding output station;

at least one of: said holder, said support device, and said centering device comprises:

an arrangement being configured and disposed to pivot a portion of at least one of: said holder, said support device, and said centering device; and an arrangement being configured and disposed to bias said pivotable arrangement in a first direction; comprising the step of:

swinging away at least one of: said holder, said support device, and said centering device, from its corresponding input station and its corresponding output station.

14. The method of operating a container filling plant according to claim 13, wherein:

said first set of rotatable wall components comprises a first rotatable wall;

said second set of stationary wall components comprises a first stationary wall; and a seal arrangement being disposed between said first rotatable wall and said first stationary wall;

comprising the step of:

sealing said at least one chamber and minimizing leakage of a disinfecting medium from said at least one chamber with said seal arrangement.

15. The method of operating a container filling plant according to claim 14, wherein:

said at least one chamber comprises an arrangement being configured and disposed to introduce a disinfecting medium free of microorganisms at its corresponding conveyer input station;

said at least one chamber comprises an arrangement being configured and disposed to remove a disinfecting medium at its corresponding conveyer output station; and said at least one chamber being configured and disposed to permit rotational flow of a disinfecting medium in said at least one chamber;

comprising the step of:

moving a disinfecting medium rotationally in said at least one chamber.

16. The method of operating a container filling plant according to claim 15, wherein:

said at least one chamber comprises at least one of: (a) and (b), wherein (a) and (b) comprise:

(a) a structure having an opening;

said opening being configured and disposed to permit introduction of the top of a container into said at least one chamber without play into said chamber and also being configured and disposed to permit positioning of the top of a container against its corresponding filling device of said filling machine;

comprising the step of:

introducing the top of a container without play into said at least one chamber; and (b) a structure having an opening;

said opening being configured and disposed to permit introduction of the top of a container into said at least one chamber with play into said chamber and also and also being configured and disposed to permit positioning of the top of a container against its corresponding filling device of said filling machine;

comprising the step of:

introducing the top of a container with play into said at least one chamber.

* * * * *